United States Patent [19]

Flider

[11] 4,069,946

[45] Jan. 24, 1978

[54] CONSUMER SAFETY CONTAINER FOR INFLAMMABLES

[75] Inventor: Frank S. Flider, Mattoon, Ill.

[73] Assignee: Justrite Manufacturing Company, Des Plaines, Ill.

[21] Appl. No.: 756,369

[22] Filed: Jan. 3, 1977

[51] Int. Cl.[2] ..... A47G 19/14

[52] U.S. Cl. ..... 222/1; 16/110.5; 222/468; 222/475; 222/518; 222/538; 251/353; 251/354

[58] Field of Search ..... 222/466–468, 222/470, 475, 501, 514, 522, 523, 538, 561, 567, 569, 402.1, 402.25, 402.14, 402.24, 1, 518, 105, 544; 141/352, 353, 360, 362; 220/85 SP; 215/1 C; D9/18, 52, 53; 251/323, 350, 353, 354; 137/587, 588; 224/45 R, 45 C; 16/110.5; 138/103, 121; 285/9 R, 334.4, DIG. 4

[56] References Cited

U.S. PATENT DOCUMENTS

| | | | |
|---|---|---|---|
| 1,062,576 | 5/1913 | Baskett et al. | 222/501 X |
| 1,090,393 | 3/1914 | Goldstein | 16/110.5 X |
| 2,197,352 | 4/1940 | Terkel | 137/588 X |
| 2,585,381 | 2/1952 | Gronemeyer et al. | 222/514 |
| 2,591,514 | 4/1952 | Courtot | 251/353 X |
| 2,815,892 | 12/1957 | Richmond | 222/475 X |
| 3,130,881 | 4/1964 | Jepson | 222/470 |
| 3,211,195 | 10/1965 | Porter | 220/85 SP |
| 3,746,200 | 7/1973 | Flider | 222/468 X |
| 3,990,523 | 11/1976 | Schramm et al. | 16/110.5 X |

*Primary Examiner*—Stanley H. Tollberg
*Assistant Examiner*—Fred A. Silverberg
*Attorney, Agent, or Firm*—Alter and Weiss

[57] ABSTRACT

An improved consumer safety container for the storage and dispensing of flammable liquids, formed as a hollow chamber having a continuously closed inner surface, the chamber having formed therein a number of tubular extensions with openings for filling, pouring and venting the container. A spring-loaded compression closure device is mounted in these openings to provide an effective seal of the container. Closure attachment means position and protect the spring loaded compression closure means within the container. Flammable liquid may be filled into or dispensed from the container by release insertion means which disengage the compression closure device.

17 Claims, 6 Drawing Figures

CONSUMER SAFETY CONTAINER FOR INFLAMMABLES

BACKGROUND OF THE INVENTION

This invention relates, generally, to consumer safety containers for inflammable, and more specifically to containers having self-sealing closure means for controlledly retaining or dispersing flammable liquid as desired.

Once common hazards associated with transportation and storage of volatile liquids have been substantially alleviated through the introduction and use of storage and filling containers formed of non-metallic, easily moldable plastic materials. Containers thus formed have no seams to rupture, are not subject to corrosion, will not dent, crack or cause sparks when dropped, and are lighter in weight than metallic containers of proportionate size. Such plastic containers are substantially of the same or greater strength and durability than the comparable metallic containers, while at the same time, being lighter and easier to handle.

A continuing problem exists, however, in providing closures for storage containers which effectively seal the container against accidental discharge of liquids or vapors, but at the same time, are designed to easily, efficiently, and safely dispense volatile liquids from the container. An area of difficulty in the past has been in protecting such closures from accidental blows or jars, which disrupt such seals. Containers, for flammable liquids are frequently transported substantial distances and subjected to extreme abuse. Numerous instances occur where these containers are jostled, tipped, or even rolled over with substantial force. The result has sometimes been that the seal of these containers has been broken, thereby releasing flammable liquids, with consequent danger to life and property.

A second problem in the past has been that it is not always desirable to open the container every time that it is tipped. It is sometimes desirable for the can to remain closed until its pouring spout or vent is brought into contact with the point desired for receiving fluids. If the closure must be opened before pouring, there is always the danger of spillage of the container while moving it into position.

An additional problem in the past has been to provide a venting mechanism which remains closed and sealed until such time as dispersal of the flammable liquid within the container is desired. This venting mechanism helps to prevent splashing, splattering or turbulence of the flammable liquid within the container when dispensing said liquid from the container. At the same time the vent must remain sealed until the time of use.

It is additionally desirable to have a container which allows the pour spout to be easily positioned in hard-to-reach places, and as close as possible to the desired point of use. Particularly, correlating the position of gripping means on the container with the position of the pour spout, and compensating for the shifting center of gravity of any liuqid container has proven to be a very difficult problem.

An additional problem has been that the vapor pressure of the flammable liquid within the container ordinarily increases from movement of the container and from any increase in outside temperature. This has had the result in the past of forcing closure mechanisms open, thereby allowing the release of flammable liquids and vapor from the container with consequent danger.

One method utilized in the past to overcome these problems has been to provide containers having weighted caps which automatically open when a can or container is tipped, and close when it is at rest. These containers answer many long-felt needs. However, they also present more problems in that, as previously mentioned, it is not always desirable to have the container opened every time that it is tipped. One method that has proven successful in overcoming this problem is the subject of U.S. Pat. No. 3,794,235, issued to the applicant herein, and assigned to the assignee of the invention, wherein a combination handle and trigger mechanism is provided outside the container to allow the container to be tipped into position before the spout is open. The present invention, as an alternative, utilizes interior placement of the closure mechanism.

Applicant in his application Ser. No. 645,431, additionally describes a safety container device which serves to solve several of the aforementioned problems. The present invention seeks to solve these problems in an alternative and/or improved manner.

Accordingly, it is an object of the present invention; to provide safety filling containers which effectively seal the closures of the containers against accidental discharge of liquids or vapors, but at the same time, provide means for easily, efficiently and effectively dispensing and filling volatile liquids into and from said container;

- to provide such containers with closures which remain selectively sealed when such container is angularly displaced;
- to provide such containers with positively closing venting mechanisms and means for easily opening such mechanisms at the time of use;
- to provide such containers with removable pour spouts which may be easily positioned to a desired point, or may be extended into hard-to-reach places;
- to provide such containers with pour spout mechanisms effectively surrounded and protected within the container itself. of the container by means of the vapor pressure within the container;
- to provide a container wherein the venting means of the container may be easily operated with one hand while the container is in the pouring attitude;
- to provide a container which may be filled by means of a pour spout from an ordinary gasoline pump without removing any portion of the closure of the container, said closure automatically closing upon withdrawal of the gasoline pump pour spout from the container.

SUMMARY OF THE INVENTION

The present invention is an improved consumer safety container for the storage and dispensing of flammable liquids. The invention comprises a liquid receptacle formed as a hollow chamber, with a continuously closed inner surface, and openings for filling, pouring and venting the container. The invention includes, for sealing the container, a closure mechanism, called in the claims, spring-loaded compression closure means, which are a cylindrical mechanism extending into an opening of the container. This mechanism, the spring-loaded compression closure means, also has attached to it vapor pressure closure means, to further secure the seal of the container. In order to release these closures, an insert device, or release insertion means, as they are called in the claims, is provided for disengaging the compression closure means, so that flammable liquid may be filled into, or dispensed from the container, or the container vented.

The invention also includes means for manually releasing accumulated vapor pressure within the container. These manual relief venting means, as they are called in the claims, are one embodiment of the closure means previously mentioned. These manual relief venting means utilize an internal mechanism essentially identical to the spring-loaded compression closure means, but employ a different release mechanism to vent the container.

In one embodiment of the invention, the previously mentioned container is blow-molded of high density polyethylene. In most cases the container would be formed of a non-metallic material as a safety feature and to reduce costs. However, the invention is not limited exclusively to non-metallic materials such as blow-molded high density polyethylene and could be constructed of steel or its equivalent.

In one embodiment of the invention, the spring-loaded compression closure means previously mentioned, comprise a tube like device called in the claims a substantially tubular spout member, which is fixedly engaged in one of the openings of the container. Within this tubular spout member is a substantially tubular spout cylinder closed at one end which is designed to slide within the tubular spout member. The closed end of the tubular spout cylinder is the first received by the tubular spout member and rests at the bottom of the tubular spout member, at its furthest extension into the container. This tubular cylinder member has ports adjacent to its closed end, which, when the spout cylinder is extended into the container, or operably positioned, as it is called in the claims, allow the flow of flammable liquid through the compression closure means. A ridge located at the bottom or first end of the substantially tubular spout member, acts as a block or check means, to prevent withdrawal of the spout cylinder member from the opening of the container. This ridge has an inside diameter slightly smaller than the inside diameter of the spout cylinder member at its end, thus preventing withdrawal of the cylinder from the container. A spring located in a groove around the spout cylinder member, and held in place by the previously mentioned check means, presses against a second right in the spout cylinder member and forces it towards the top of the container, thereby retaining the closed end of the substantially tubular spout cylinder member against the previously mentioned first end of the tubular spout member. Sealing means attached to the closed end of the spout cylinder member, seal the space between the tubular spout member and the tubular cylinder member from the pressure provided by the spring means. The spring loaded compression closure means are also sealed where fixedly attached to the opening providing an effective liquid seal of the opening of the container.

The invention further includes vapor pressure closure means for reinforcing the seal of the container. As previously mentioned, seal means received about the closed end of the substantially tubular spout cylinder member are held in place against the first end of the spout member by spring means. A pressure plate attached to and extending from this closed end of the substantially tubular spout cylinder member is positioned within the container. Since the container is sealed, movement of the flammable liquid in the container, as well as any increase in temperature, causes an increase in the vapor pressure within the container. This vapor pressure pushes against the pressure plate, which further compresses the sealing means of the container, thus providing a more effective seal. In addition, if the container is overturned, flammable liquid within the container also presses against the pressure plate, thereby providing a more effective seal and preventing the escape of any flammable liquid from the container.

The invention further includes closing attachment means which comprise a substantially tubular aperture cover member fixedly attached about the outside of one or more of the openings in the container. Integrally connected with the aperture cover member are the spring loaded compression closure means. The closure cover member extends from the opening of the container and provides protection for the spring loaded compression closure means contained within. In addition, the closure cover member positions the spring loaded compression closure means within the container.

An additional embodiment of the spring loaded compression closure means are the manual relief venting means, which comprise a tubular vent cylinder seated on and extending into the opening of the container. The tubular vent cylinder member has at its first end a circular flange of a diameter greater than the diameter of the opening in the container, so as to prevent further insertion of the cylinder into the container. A vent pin member extends through the tubular vent cylinder member. A vapor discharge slot is integrally formed into the vent pin member. When the vent pin member is manually inserted into the container, this vapor discharge slot acts as a passageway to relieve the vapor pressure within the container, and to allow air to enter. Check means at the first end of the tubular vent cylinder member prevent withdrawal of the vent pin member from the manual relief venting means. Vent spring means engaged about the vent pin member and held in place by the previously mentioned check means, as well as by a groove in the vent pin member, hold a first end of the vent pin member, against a second end of the tubular vent cylinder member. Seal means attached to this same first end of the vent pin member, in cooperation with the spring means previously mentioned, provide an effective seal between the end of the vent pin member and the end of the tubular cylinder member.

Vapor pressure closure means attached to a first end of the vent pin cooperate with the seal means to reinforce the seal between the first end of the vent pin member and the second end of the tubular vent cylinder member. In one embodiment of the invention, the vapor pressure closure means constitute a pressure plate attached to the first end of the vent pin member.

An additional embodiment of the vent manual relief venting means comprises an end grip, integrally formed into one side of the liquid receptacle. The pour spout of the container is on the opposite side of the liquid receptacle, or on top of the liquid receptacle, but still on the opposing side of the container. The end grip is directly adjacent to the vent pin member so that the container can be tipped and held in place until venting is desired, and then the vent pin member inserted into the container by thumb pressure, thus releasing vapor pressure within the container, and allowing venting of the container during pouring.

The invention further includes release insertion means for disengaging the compression closure means and vapor pressure closure means previously mentioned. In one embodiment, these release insertion means comprise a substantially tubular spout insert member. Within the substantially tubular spot member previously mentioned, is a spout insert receiving ridge. The substantially tubular spout insert member has an outside diameter substantially less than the inside diameter of the substantially tubular spout cylinder member for telescopic receipt thereof. However, the spout insert receiving ridge has an inside diameter less the inside diameter of the substantially tubular spout insert member. Therefore, when the spout insert member is inserted into the spout cylinder member, it comes into contact with, and is stopped by the spout insert receiving ridge, which causes the spout cylinder member to move, disengaging the spring-loaded compression closure means, and thus opening a pour path for flammable liquids from the container.

In another embodiment, the spout insert member further comprises a tubular spout insert tip member, having a progressive series of circular ribs about its circumference, fixedly attached to a first end of the spout insert member. The progressive series of circular ribs increase in diameter so that a substantial number of these ribs have an outside diameter substantially greater than the inside diameter of the tubular spouts cylinder member. When the tubular spout insert tip member, attached to the spout insert member, is telescopically received by the spout cylinder member, it is wedged into place with a friction fit, thereby facilitating dispersal of the flammable liquid from the spout insert member. The tubular spout insert tip member is constructed of a semi-rigid material, flexible enough to allow insertion of the tip member into the tubular cylinder member, but rigid enough to hold the circular ribs in place against the cylinder member.

An additional embodiment of the spout insert member comprises a gripping attachment to the spout insert member, for cooperation with the spout cylinder member in disengagement of the spring-loaded compression closure means, thereby creating a pour path from the container. These gripping means have pronged extensions or hooking means attached thereto. The pronged extensions are juxtaposed one to the other so that the distance between them is substantially equal to the outside diameter of the aperture cover member. These pronged extensions make it easier to retain the spout insert member against the opening of the container.

A specific embodiment of release insertion means, designed for disengaging the manual relief venting means previously mentioned, comprises a vent pin head member integrally connected with a second outside end of the vent pin member. With this vent pin head member fixedly attached, the vent pin member extends from the closure attachment means. The outside end of the vent pin head member has a circular disc fixedly attached to prevent insertion of the vent pin member beyond the circular disc, and to facilitate thumb pressure. When this vent pin head member is pressed, the vent pin member slidingly moves in the tubular vent cylinder member. This exposes the vapor discharge slot within the container which acts as a passageway to release vapor out of the container and to admit air.

In order to more effectively utilize the invention, handle means are integrally formed into the top outer surface of the liquid receptacle. In one embodiment of the invention, the openings from the container for filling, pouring and venting, are actually in these handle means. In this and other embodiments of the handle means, an opening or hand placement channel runs parallel to the upper surface of the container, but perpendicular to the openings in the container. When the handle is gripped, and fingers placed through the placement channel, the container may be easily carried. In addition, by having the handle so close to the pour opening of the container, the user can position his hand with the pour opening extremely close to the desired point of use. In one additional embodiment of the invention, spout insert member storage means are integrally formed into the handle means, to hold the spout insert member until use is desired.

The invention also includes a method for dispensing liquids from a container having spring-loaded compression closure means, telescopically received within. The method comprises several steps.

1. Inserting a tubular spout insert member telescopically into a tubular spout cylinder member.
2. Pushing the spout insert member against the spout insert member receiving ridge within the tubular cylinder member.
3. Sliding the spout cylinder member within the spring-loaded compression closure means telescopically into the container, thereby disengaging the spring loaded compression closure means and exposing port inlets within the spout cylinder member.
4. Pouring flammable liquid through the port inlets into the spout cylinder member, through the spout cylinder member into the spout insert member and out of the spout insert member.

DETAILED DESCRIPTION OF THE DRAWINGS

Figure 1:
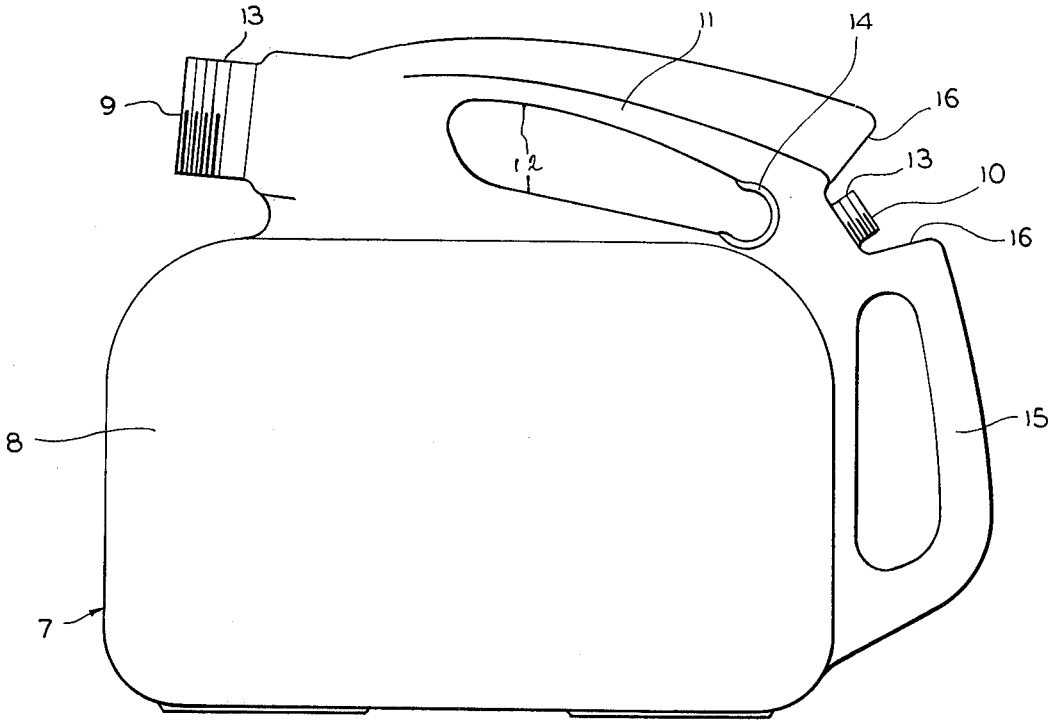
FIG. 1 of the drawings is a side perspective view of an improved consumer safety container for the storage and dispensing of flammable liquids.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Improved consumer safety container 7, as shown in FIG. 1 comprises, a liquid receptacle 8 formed as a hollow chamber with an opening 9 for filling and pouring from the container, and an opening 10, for venting the container. In this particular embodiment of the invention, handle means 11 are integrally formed into the outer surface of the container. Through these handle means 11, are hand-placement channel 12, which facilitate gripping of the container close to the pour opening 9 when pouring from the container. In this embodiment of the invention, openings 9 and 10 are integrally formed into a handle means 11. Further, openings 9 and 10 are telescopically extended from handle means 11 and have a series of threads 13 integrally formed into their outside surface, to facilitate the fixed attachment of closures. Also, integrally formed in handle means 11 are spout insert member storage means 14, for transporting a spout insert member to be described in FIG. 4.

Additionally shown in FIG. 1 is end grip means 15 integrally formed into the side of container 7, for tipping the container 7. Manual relief vent recess aperture 16 located between handle means 11 and end grip means 15, is designed to protect vent opening 10 of the container against accidental impact.

Figure 2:
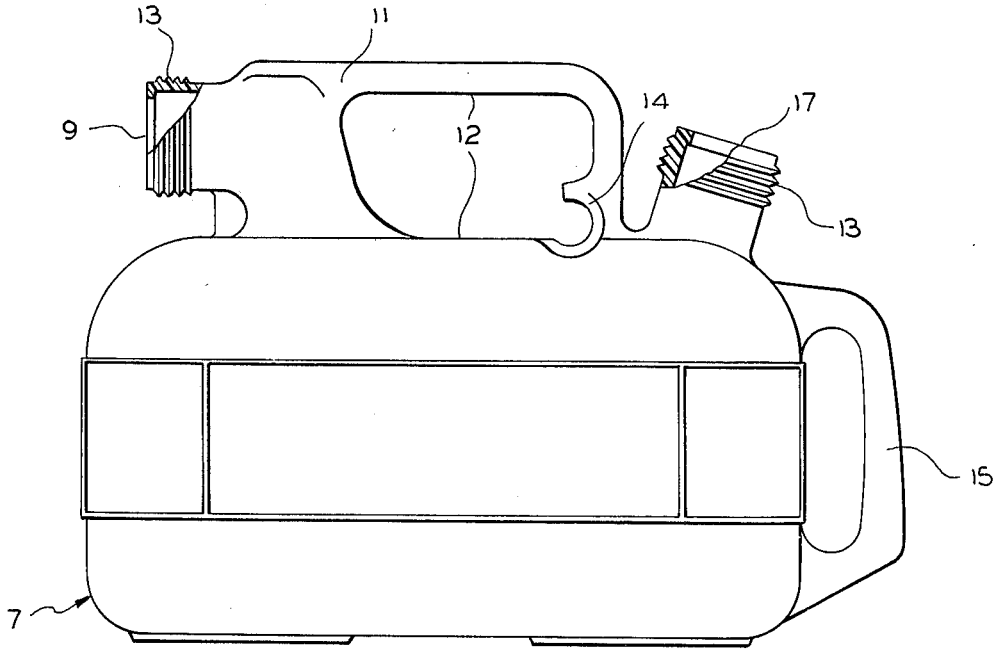
FIG. 2 of the drawings is a side perspective view of another embodiment of the invention, showing in particular, handle means integrally formed in the top outer surface of the liquid receptacle, with a pour opening therein, and a separate fill opening formed into the outside of the liquid receptacle.

FIG. 2 of the drawings shows an additional embodiment of the invention in which improved consumer safety container 7 has handle means 11 integrally formed into the top of the container 7, and pour opening 9 integrally formed therein. However, instead of vent opening 10, this embodiment of the invention has fill opening 17 integrally formed into the top surface of the container 7, and located between handle means 11 and end grip means 15. This placement facilitates pouring of flammable liquid into the container through fill opening 17. Additionally shown are hand placement channel 12, integrally formed into handle means 11 for transportation of the container 7, and spout insert member storage means 14 for transporting the spout insert member shown in FIG. 4.

Figure 3:
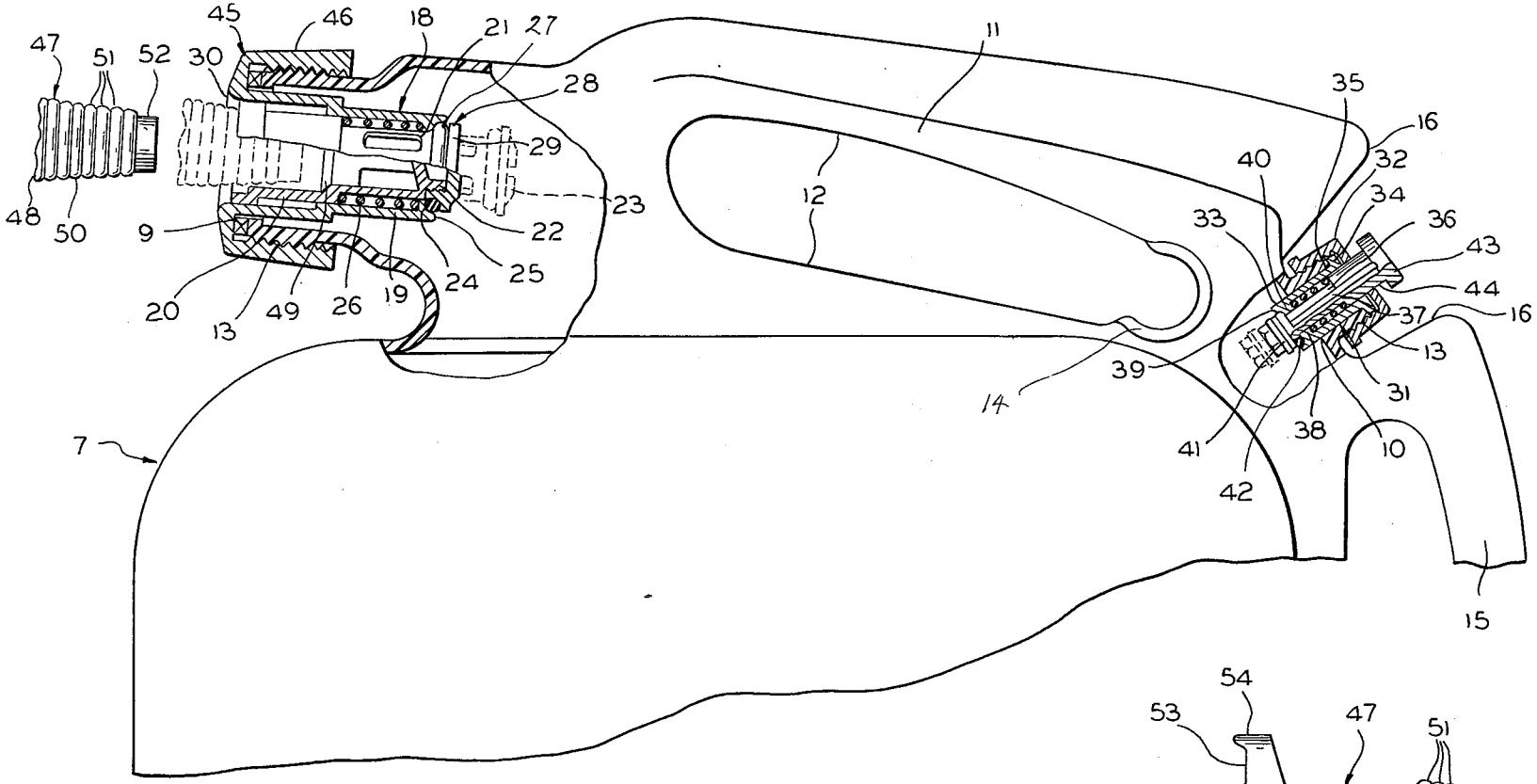
FIG. 3 of the drawings is a side cut-away view of one embodiment of the invention, showing, in particular, spring-loaded compression closure means fixedly attached to one of the openings in the container.

FIG. 3 of the drawings shows the container 7 with pour opening 9 integrally formed into handle means 11 and telescopically extending from handle means 11, with a series of threads 13 integrally formed into the outside of pour opening 9. Fixedly attached to pour opening 9 is spring-loaded compression closure means 18. In this embodiment of the invention, spring-loaded compression closure means 18 comprises a substantially tubular spout member 19, telescopically received in fill opening 9. Within substantially tubular spout member 19 is substantially tubular spout cylinder member 20, slidingly positioned. Spout cylinder member 20 has port inlets 21 integrally formed therein, and in close juxtaposition to end 22 of spout cylinder member 20. When spout cylinder member 20 is slid into the container 7, as shown in diagram 23, a pour path for the flow of flammable liquid from the container 7, through the spring-loaded compression closure means 18, is created. Check means 24 attached to substantially tubular spout member 19 at a first end 25, prevents withdrawal of spout cylinder member 20 from the container 7. Spring means 26 engaged about spout cylinder member 20 cooperate with check means 24 to retain closed end 22 of spout cylinder member 20 in close juxtaposition to first end 25 of substantially tubular spout member 19. Seal means 27 attached to closed end 22 of spout cylinder member 20, cooperate with spring means 26 to provide an effective liquid seal between the first end 25 of substantially tubular spout member 19 and the closed end 22 of substantially tubular spout cylinder member 20.

Also shown in FIG. 3 are vapor pressure closure means 28 which comprise pressure plate means 29 attached to the closed end 22 of spout cylinder member 20. When the vapor pressure from flammable liquid within the container increases, force is created which pushes against pressure plate means 29, thereby facilitating movement of spout cylinder 20 towards the second end 30 of substantially tubular spout member 19. This, in turn, causes closed end 22 of spout cylinder member 20 to exert additional force against seal means 27, thereby reinforcing these seal means.

Also shown in FIG. 3 are manual relief venting means 31, fixedly attached to vent opening 10. In this embodiment of the invention, vent opening 10 is telescopically extended and has a series of threads 13, integrally formed about its outer surface to facilitate attachment of the manual relief venting means 31. Also in this embodiment of the invention, vent opening 10 is positioned within manual relief vent recess aperture 16, to protect manual relief venting means 31 against accidental disengagement. In this embodiment of the invention, manual relief venting means 31 comprises vent aperture cover member 32, fixedly attached to vent opening 10.

Substantially tubular vent cylinder member 33 is operably positioned within vent opening 10. Circular flange means 34 fixedly attached to a first end 35 of vent cylinder member 33, restrain vent cylinder member 33 in vent opening 10. Vent pin member 36 is slidingly positioned in substantially tubular vent cylinder member 33. A vapor pressure discharge slot 37 is integrally formed into the length of the vent pin member 36, so that when the vent pin member is depressed, in its operative position into the container 7, a channel is thereby created for discharging the accumulated vapor pressure within the container, and allowing air to pass into the container. Vent pin check means 38 attached to a second end 39, of substantially tubular vent cylinder member 33, prevent withdrawal of vent pin member 36 from manual relief venting means 31. Vent spring means 40 are engaged about vent pin member 36 and push against vent pin member 36 in an outward direction, but vent pin check means 38 hold the vent pin member 36 in place. The result is that the first end 41 of vent pin member 36 is held in close juxtaposition to the second end 39 of substantially tubular vent cylinder member 33. Vent seal means 42 are attached to the first end 41 of vent pin member 36, so that when spring means 40 push against vent pin member 36, the first end 41 of vent pin member 36 pushes against vent seal means 42 to provide an effective liquid seal between first end 41 of vent pin member 36 and second end 39 of substantially tubular vent cylinder member 33.

Release insertion means, in this case, a vent pin head member 43 are integrally connected to a second end 44 of vent pin member 36 to facilitate insertion of vent pin member 36 into the container 7, causing the disengagement of manual relief venting means 31, and the release of accumulated vapor pressure in the container.

Also shown in FIG. 3 is closure attachment means 45 which comprise an aperture cover member 46, integrally connected with spring-loaded compression closure means 18. Aperture cover member 46 is itself fixedly attached to opening 9 in container 7. Aperture cover member 46 is located outside opening 9 so as to enclose and position spring-loaded compression closure means 18 within container 7.

Additionally shown in FIG. 3 is a further embodiment of manual relief venting means 31, in which end grip means 15 are integrally formed into a first side of liquid receptacle 8. End grip means 15 are positioned as far away as possible from port opening 9, to facilitate balancing of the container during pouring. Manual relief vent recess aperture 16 is integrally formed into the end grip means 15 in order to protect manual relief venting means 31 against accidental disengagement. In addition, manual relief vent recess aperture 16 is positioned so that the user during pouring can apply thumb pressure to vent pin head member 36, sliding it into substantially tubular vent cylinder member 33, thereby disengaging manual relief venting means 31, and allowing venting of the container. Also shown in FIG. 3 are handle means 11 integrally formed into the top of container 7. Hand placement channel 12 runs through handle means 11 for gripping handle means 11 during transportation and use of the container 7. Spout insert member storage means 14 is also integrally formed into handle means 11 for transportation and storage of the spout insert member shown in FIG. 4.

In a schematic diagram in FIG. 3, one further embodiment of release insertion means, designated number 47, is shown. In particular, a spout insert member 48 is shown being telescopically received by spring-loaded compression closure means 18. Within spring loaded compression closure means 18, is a circular spout insert receiving ridge 49 having an inside diameter less than the outside diameter of spout insert member 48, thus preventing further insertion of spout insert member 48. However, by pushing spout insert member 48 against circular spout insert receiving ridge 49, spring-loaded compression closure means 18 may be slidingly disengaged, thereby exposing port inlets 21 in container 7, and creating a pour path from the container 7 through spring-loaded compression closure means 18, and also through spout insert member 48.

In this particular embodiment of the invention, tubular spout insert member 48 has a tubular spout insert tip member 50 fixedly attached at one end. Tubular spout insert tip member 50 has a progressive series of circular ribs 51 about its circumference, which increase in diameter from a first end 52 of spout insert tip member 50, so that a substantial number of said ribs 51 have an outside diameter greater than the inside diameter of substantially tubular spout cylinder member 20. This allows tubular spout insert tip member 50 to be wedged into spout cylinder member 20, making it easier to tip the container 7 and pour liquids therefrom.

Figure 4:
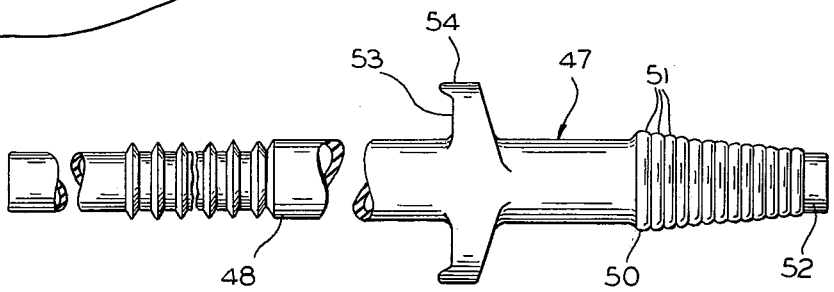
FIG. 4 of the drawings is one embodiment of release insertion means, showing in particular, a tubular spout insert tip member, fixedly attached to a first end of the spout insert member.

FIG. 4 of the drawings shows a full length drawing of substantially tubular spout insert member 48, designed to be telescopically received in spring-loaded compression closure means 18. Attached to spout insert member 48 is a tubular spout insert tip member 50, having a progressive series of circular ribs 51 about its circumference for a friction fit within spring-loaded compression closure means 18. Attached to spout insert member 48 are gripping means 53 for holding the spout insert member 48 against the spring-loaded compression closure means 18. At the end of each of these gripping means 53, hooking means 54 which are pronged extensions, emanate from gripping means 53. These hooking means 54 are juxtaposed one to the other such that the distance between each pronged extension is substantially equal to the outside diameter of closure attachment 45, to facilitate manual retention of spout insert member 48 in close juxtaposition to closure attachment means 45.

Figure 5:
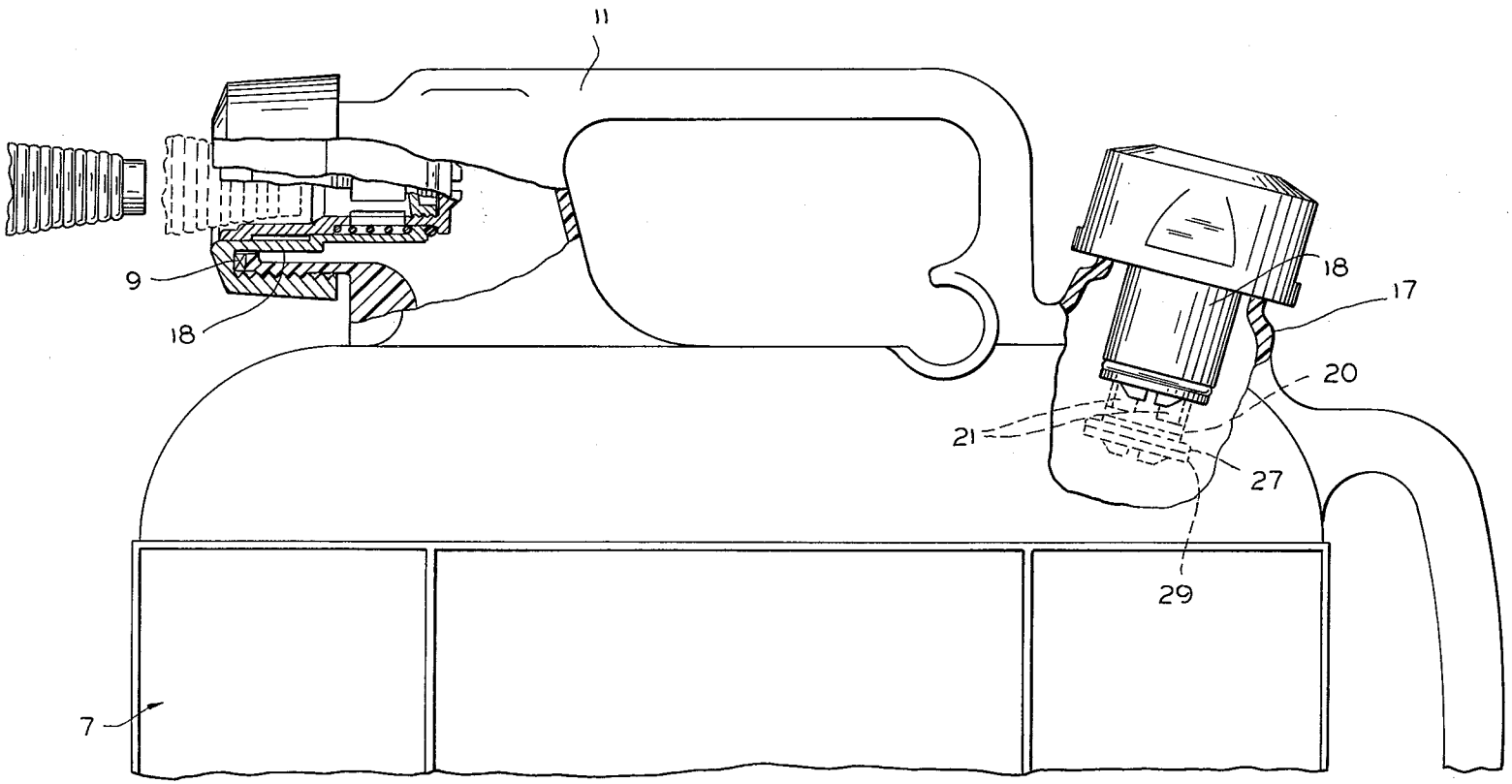
FIG. 5 of the drawings is a side cut-away view of one embodiment of the invention, showing in particular, separate openings in the container for filling and pouring.

FIG. 5 of the drawings is a side cut-away view of an additional embodiment of the invention showing, in particular, an improved consumer safety container for the storage and dispensing of flammable liquids 7, as seen in FIG. 2, in which pour opening 9 is an integral part of handle means 11, and spring-loaded compression closure means 18 are fixedly attached to pour opening 9. In this embodiment of the invention, however, venting and filling of the container are accomplished through fill opening 17, which has identical spring-loaded compression closure means 18 as pour opening 9. Shown with particular clarity is a schematic of pressure plate means 29 and seal means 27, fixedly attached to substantially tubular spout cylinder member 20, being slidingly positioned into container 7, thereby exposing port inlets 21 and creating a pour path into the container.

Figure 6:
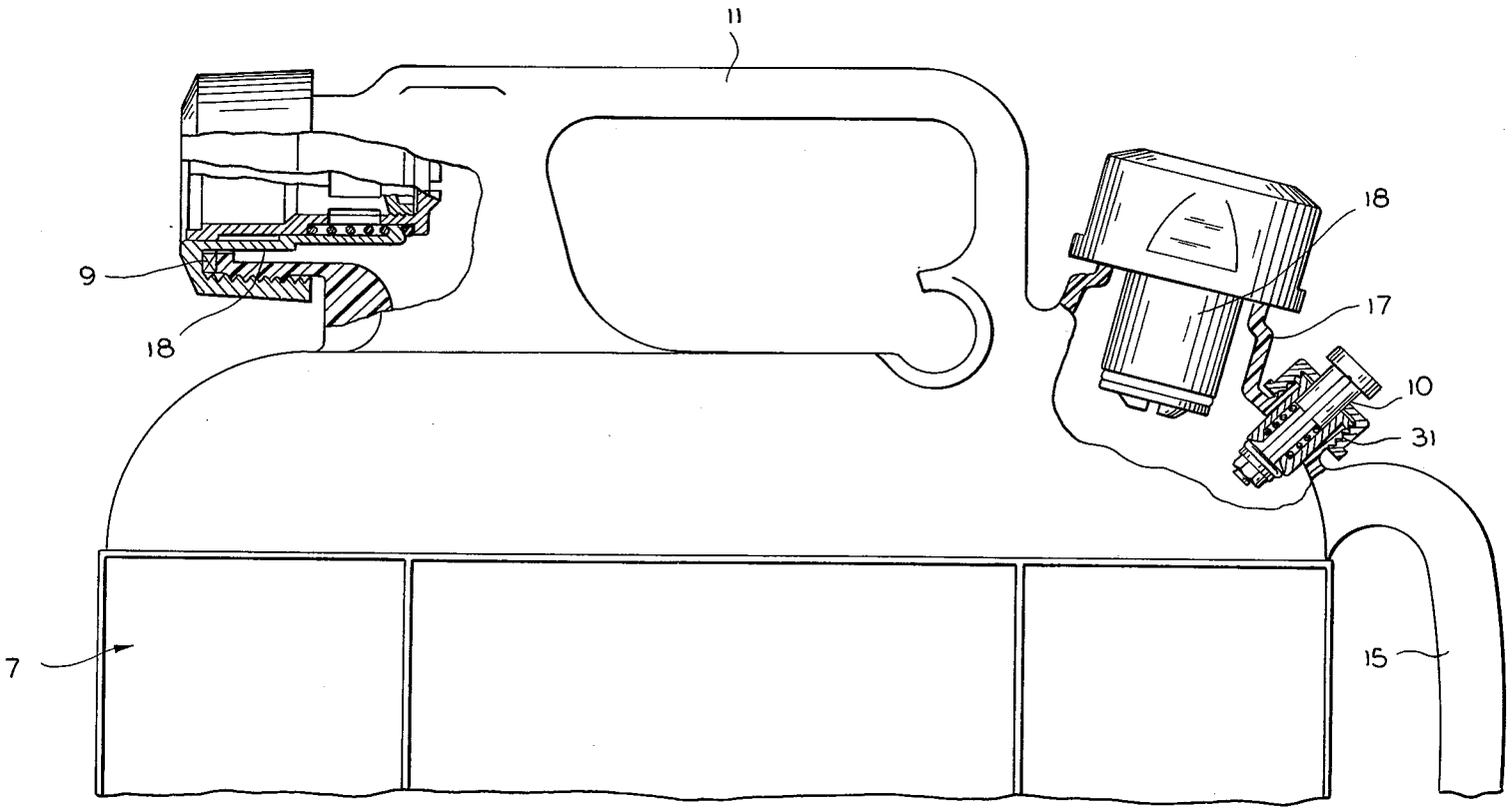
FIG. 6 of the drawings is a side cut-away view of the same container as shown in FIG. 5, but showing in addition, a third opening with manual relief venting means fixedly attached therein.

FIG. 6 of the drawings is an additional embodiment of improved consumer safety container 7 showing, in general, pour opening 9 integrally formed into handle means 11. Spring-loaded compression closure means 18 are fixedly attached to pour opening 9. Fill opening 17 is integrally formed at the opposite side of the container 7, with spring-loaded compression closure means 18 fixedly attached therein. In this embodiment of the invention, however, container 7 has an additional vent hole 10, in which manual relief venting means 31 are fixedly engaged. Release insertion means can be utilized to disengage the spring-loaded compression closure means 18 in either pour opening 9, fill opening 17, or vent opening 10. It should be noted that manual relief venting means 31 is in close juxtaposition to end grip means 15, thereby allowing the container to be tipped without opening any closures of the container, and then to be easily vented in this tipped position.

The foregoing description and drawings merely explain and illustrate the invention and the invention is not limited except insofar as the appended claims are so limited thereto, as those skilled in the art who have the disclosure before them will be able to make modifications and variations therein without departing from the scope of the invention.

What is claimed is:

1. An improved consumer safety container for the storage and dispensing of flammable liquids which comprises:

liquid receptacle means having a hollow chamber for containing said flammable liquids, said chamber having formed therein one or more openings for filling of said container, the pouring from said container, and venting of said container;

spring-loaded compression closure means fixedly attached to at least one of said one or more openings to provide an effective liquid seal of said openings from within said container;

release insertion means for disengaging said spring-loaded compression closure means; whereby flammable liquid may be alternatively filled into or dispensed from said container, said release insertion means detachable from said spring-loaded compression closure means when not in use so as to be unobtrusive; and closure attachment means for securely and restrainably attaching said spring-loaded compression closure means within said container in said one or more openings, and allowing removability of said spring-loaded compression closure means from said container as desired.

2. The invention according to claim 1, in which said improved safety container further comprises:

vapor pressure closure means attached to said spring-loaded compression closure means to further secure said liquid seal of said container.

3. The invention according to claim 2 in which said container is blow molded of high density polyethylene.

4. The invention according to claim 1 in which spring-loaded compression closure means comprises:

a substantially tubular spout member, having continuous sides telescopically received within and fixedly engaged with said opening of said container;

a substantially tubular spout cylinder member closed at one end slidingly received within said substantially tubular spout member;

port inlets formed as an integral part of said substantially tubular spout cylinder member, in close juxtaposition to said closed end of said substantially tubular spout cylinder member, to alternatively enable the flow of said liquid through said spring-loaded compression closure means when said substantially tubular spout cylinder means is depressed into said container to expose said ports to said container contents, or block the flow of said liquid at said closed end otherwise;

check means fixedly attached to said substantially tubular spout member at a first end, cooperating with said substantially tubular spout cylinder member at its closed end to prevent withdrawal of said spout cylinder member from said spout member, said check means defining a limit to which said tubular spout cylinder member can be telescopically depressed;

spring means engaged about said substantially tubular spout cylinder member cooperating with said check means to retain said closed end of said substantially tubular spout cylinder member in close juxtaposition to said first end of said substantially tubular spout member; and seal means attached to said closed end of said substantially tubular spout cylinder member which cooperate with said spring means to provide an effective liquid seal between said first end of said substantially tubular spout member and said closed end of said substantially tubular spout cylinder member, thereby preventing escape of said liquid when said tubular spout cylinder member is not depressed.

5. The invention according to claim 4 in which said vapor pressure closure means comprises:

pressure plate means attached to said closed end of said substantially tubular spout cylinder member positioned within said container, said pressure plate means cooperating with said substantially tubular spout cylinder member and said seal means to reinforce the liquid seal between said substantially tubular spout cylinder member and said substantially tubular spout member, said pressure plate means being actuated by an accumulation of vapor pressure from said flammable liquid within said container, or by an accumulation of said flammable liquid against said pressure plate.

6. The invention according to claim 4 in which said release insertion means comprises:

a substantially tubular spout insert member; and a spout insert receiving ridge operably positioned within said substantially tubular spout cylinder member, for reception of and abutment with said substantially tubular spout insert member in close juxtaposition, said substantially tubular spout insert member having an outside diameter substantially less than the inside diameter of said substantially tubular spout cylinder member for telescopic receipt thereof, but substantially greater than the inside diameter of said spout insert receiving ridge, said spout insert member cooperating with said spout insert receiving ridge to facilitate disengagement of said first end of said spring-loaded compression closure means when pressure is applied against said spout insert receiving ridge through said spout insert member, said disengagement creating a pour path from said container through said spring-loaded compression closure means into and through said spout insert member.

7. The invention according to claim 6 in which said release insertion means further comprises:

a tubular spout insert tip member, having a progressive series of circular ribs about its circumference, said spout insert tip member being fixedly attached to a first end of said spout insert member, said progressive series of circular ribs increasing in diameter from a first end of said spout insert tip member so that a substantial number of said ribs have an outside diameter greater than the inside diameter of said substantially tubular spout cylinder member, said progressive series of circular ribs facilitating a friction fit of said spout insert tup member in said spout cylinder member upon insertion of said spout insert tip member.

8. The invention according to claim 6 in which said release insertion means further comprises:

gripping means attached to said spout insert member to facilitate manual insertion of said spout insert member into said spring-loaded compression closure means.

9. The invention according to claim 8 in which said gripping means further comprises:

hooking means fixedly attached to said spout insert member; said hooking means comprising pronged extensions emanating from said gripping means;

said hooking means being juxtaposed one to the other such that the distance between said pronged extensions is substantially equal to the outside diameter of said closure attachment means, said hooking means facilitating gripping of said spout insert member in close juxtaposition to said closure cover means, to maintain disengagement of said spring-loaded compression closure means.

10. The invention according to claim 1 in which said spring-loaded compression closure means comprises:

manual relief venting means fixedly attached to one of the openings of said container for release of accumulated vapor pressure within said container and for venting of said container during pouring.

11. The invention according to claim 10 in which said manual relief venting means comprises:

a substantially tubular vent cylinder member operably positioned within one of said openings in said container;

circular flange means fixedly attached at a first end of said substantially tubular vent cylinder member to position said substantially tubular vent cylinder member in said opening;

a vent pin member slidingly positioned within said substantially tubular vent cylinder member;

a vapor pressure discharge slot integrally formed into the length of said vent pin member to enable the passage of air into said container when said pin member is depressed, thereby venting said container;

vent pin check means attached to a second end of said substantially tubular vent cylinder member to prevent withdrawal of said vent pin member from said manual relief venting means;

vent spring means engaged about said vent pin member which cooperate with said vent pin check means to retain the first end of said vent pin member in close juxtaposition to said second end of said substantially tubular vent cylinder member, said vent spring means enabling depression of said pin member to vent said container; and vent seal means attached to said first end of said vent pin member which cooperate with said vent spring means to provide an effective liquid seal between said first end of said vent pin member and said second end of said substantially tubular vent cylinder member.

12. The invention according to claim 11 in which said manual relief venting means further comprises:

end grip means integrally formed into a first side of said liquid receptacle and located proximate said vent pin member, said end grip means being positioned so as to facilitate manual depression of said vent pin member into said substantially tubular vent cylinder member when gripping said end grip means thereby enabling one-handed simultaneous pouring from and venting of said container.

13. The invention according to claim 11 in which said release insertion means for disengaging said spring-loaded compression closure means comprises:

a vent pin head member integrally connected to a second end of said vent pin member to facilitate manual insertion of said vent pin member into said manual relief venting means, said insertion causing the disengagement of said spring-loaded compression closure means and the release of accumulated vapor pressure within the container, as well as the entrance of air into the container.

14. The invention according to claim 1 in which said closure attachment means comprises:

an aperture cover member fixedly attached to one of said openings in said container, said aperture cover member being integrally connected with said spring-loaded compression closure means, said aperture cover member being positioned outside said opening so as to enclose, protect, and fixedly restrain said spring-loaded compression closure means within said container.

15. The invention according to claim 1 wherein said container further comprises:

handle means integrally formed into the top outer surface of said liquid receptacle, to facilitate dispersing, said openings in said container for filling, pouring, and venting of said container, located within said handle means.

16. The invention according to claim 15 wherein said handle means further comprises:

spout insert member storage means integrally formed therein to facilitate transportation, storage, and ready access to said spout insert member as desired.

17. A method for the dispensing of liquids, such as flammable liquids from a container having openings with spring-loaded compression closure means designed to telescopically receive spout insert means, said method for dispensing comprising the steps of:

a. inserting a spout insert member into said spring-loaded compression closure means;

b. pushing said spout insert member against a spout insert member receiving ridge within said spring-loaded compression closure means;

c. sliding the substantially tubular spout cylinder member within said spring-loaded compression closure means;

d. disengaging said spring-loaded compression closure means by said sliding movement;

e. exposing one or more port inlets in the substantially tubular spout cylinder member to the flammable liquid within the container through said disengagement of said spring-loaded compression closure means;

f. pouring said flammable liquid through said port inlets, into and through said spout cylinder member, into and through said spout insert member and to a desired point of use; and detachably removing said spout insert member from said spring-loaded compression closure means.

* * * * *

UNITED STATES PATENT AND TRADEMARK OFFICE

CERTIFICATE OF CORRECTION

PATENT NO. : 4,069,946

DATED : January 24, 1978

INVENTOR(S) : Frank S. Flider

It is certified that error appears in the above-identified patent and that said Letters Patent are hereby corrected as shown below:

| | |
|---|---|
| Col. 2; Line 42: | Add the following sentence (new paragraph): --to provide closure mechanism which reinforce sealing of the container by means of the vapor pressure within the container;-- |
| Col. 3; Line 46: | Delete "right" and insert --ridge--. |
| Col. 4; Line 22: | After the word "vent cylinder" add the word --member--. |
| Col. 4; Line 47: | After the word "vent pin" add the word --member--. |
| Col. 5; Line 2: | Delete the word "spot" and insert --spout--. |
| Col. 10; Line 37: | After the word "limited" add the word --thereto--. |
| Col. 10; Line 38: | Delete the word "thereto,". |
| Col. 14; Line 49: | Insert the following before "detachably removing said spout insert member from said spring-loaded compression closure means.", --g.--. |

UNITED STATES PATENT OFFICE

CERTIFICATE OF CORRECTION

Patent No. 4,069,946 Dated January 24, 1978

Inventor(s) Frank S. Flider

It is certified that error appears in the above-identified patent and that said Letters Patent are hereby corrected as shown below:

Column 2, lines 41-42 Delete "of the container by means of the vapor pressure within the container;"

Signed and Sealed this

Sixth Day of June 1978

[SEAL]

*Attest:*

RUTH C. MASON
*Attesting Officer*

DONALD W. BANNER
*Commissioner of Patents and Trademarks*